US010794020B2

(12) United States Patent
Rill

(10) Patent No.: US 10,794,020 B2
(45) Date of Patent: Oct. 6, 2020

(54) BRIDGING DEVICE FOR A CONSTRUCTION JOINT WITH A HYDRAULIC CONTROL DEVICE

(71) Applicant: MAURER ENGINEERING GMBH, Munich (DE)

(72) Inventor: Daniel Rill, Munich (DE)

(73) Assignee: MAURER ENGINEERING GMBH, Munich (DE)

( * ) Notice: Subject to any disclaimer, the term of this patent is extended or adjusted under 35 U.S.C. 154(b) by 19 days.

(21) Appl. No.: 16/304,777

(22) PCT Filed: Aug. 22, 2017

(86) PCT No.: PCT/EP2017/071169
§ 371 (c)(1),
(2) Date: Nov. 27, 2018

(87) PCT Pub. No.: WO2018/068935
PCT Pub. Date: Apr. 19, 2018

(65) Prior Publication Data

US 2020/0270828 A1 Aug. 27, 2020

(30) Foreign Application Priority Data

Oct. 12, 2016 (DE) ..... 10 2016 219 852

(51) Int. Cl.
*E01D 19/00* (2006.01)
*E01D 19/06* (2006.01)

(52) U.S. Cl.
CPC ..... *E01D 19/06* (2013.01)

(58) Field of Classification Search
CPC ..... E01D 19/06
(Continued)

(56) References Cited

U.S. PATENT DOCUMENTS 3,732,021 A * 5/1973 Rizza ..... E01D 19/062 404/57
3,797,952 A * 3/1974 Pommerening ..... E01D 19/062 404/52

(Continued)

FOREIGN PATENT DOCUMENTS

| | | |
|---|---|---|
| CH | 666 303 A5 | 7/1988 |
| DE | 20 60 482 A1 | 7/1972 |
| DE | 74 15 898 U | 1/1977 |

*Primary Examiner* — Raymond W Addie
(74) *Attorney, Agent, or Firm* — Baker & Hostetler LLP

(57) ABSTRACT

A bridging device for a construction joint between a first construction part and a second construction part with several lamellae and at least one hydraulic control device for controlling the gap width between the lamellae. The hydraulic control device has double-acting hydraulic cylinders each with a movable piston and a piston rod arranged on the piston, each hydraulic cylinder being arranged on a lamella. Each piston rod is connected to a different lamella, wherein the piston defines a first working volume and a second working volume of the corresponding hydraulic cylinder. The invention is wherein the hydraulic control device comprises at least three double-acting hydraulic cylinders connected to each other by a hydraulic connection whereby the first working volume of each hydraulic cylinder is hydraulically connected to the second working volume of another hydraulic cylinder so as to form a hydraulic loop between the at least three hydraulic cylinders.

17 Claims, 8 Drawing Sheets

(58) Field of Classification Search
USPC ..... 14/73.1, 73.5; 404/47, 74
See application file for complete search history.

(56) References Cited

U.S. PATENT DOCUMENTS

| | | | | |
|---|---|---|---|---|
| 5,319,712 | A * | 6/1994 | Finkelstein | H04L 29/06 380/44 |
| 6,022,169 | A * | 2/2000 | Kim | E01D 19/062 404/52 |
| 2004/0016065 | A1* | 1/2004 | Steiger | E01D 19/062 14/73.1 |
| 2005/0262650 | A1* | 12/2005 | Bradford | E01D 19/062 14/73.1 |
| 2008/0148499 | A1* | 6/2008 | Bradfopd | E01D 19/06 14/73.5 |

* cited by examiner

BRIDGING DEVICE FOR A CONSTRUCTION JOINT WITH A HYDRAULIC CONTROL DEVICE

CROSS-REFERENCE TO RELATED APPLICATIONS

This application is a National Stage of International patent application PCT/EP2017/071169, filed on Aug. 22, 2017, which claims priority to foreign German patent application No. DE 10 2016 219 852.1, filed on Oct. 12, 2016, the disclosures of which are incorporated by reference in their entirety.

FIELD OF THE INVENTION

The present invention relates to a bridging device in lamellar construction for a construction joint between a first construction part and a second construction part with several lamellas. The bridging device has a hydraulic control device for controlling the gap width between the laminae, wherein the hydraulic control device comprises double-acting hydraulic cylinders each with a movable piston and a piston rod arranged on the piston. Each hydraulic cylinder is arranged on a lamella and each piston rod is connected to another lamella. The piston defines a first working volume and a second working volume of the corresponding hydraulic cylinder. For the purposes of the application, a lamella is also to be understood as the edge girder of a bridging device.

BACKGROUND

The construction joints, also known as movement joints or expansion joints, are used to compensate movements of the construction parts relative to each other in order to prevent damage. In particular, the structural parts can be two parts of a bridge structure, e.g. bridge head or abutment and bridge deck or bridge girder as well as adjacent bridge girders. Such movements of the construction parts towards each other are unavoidable and can occur, for example, due to thermal expansion or creep and shrinkage of the construction materials used. Furthermore, movements can also occur due to loads caused by the passage of persons or vehicles, for example caused by brake loads during braking of vehicles. Shock loads occur directly in the area of the bridging device, especially during heavy braking.

Bridging devices are therefore generally used to bridge the construction joint between the two construction parts in such a way that vehicles and living beings can move safely from one construction part to the next. The use of bridging devices in lamellar construction (which is also known as center girder construction) has proved to be successful. The bridging device comprises several lamellas, which are movably arranged on a cross beam mounted on the two structural parts. So-called control devices are used to keep the variable gap widths between adjacent lamellas or a lamella and an edge girder constant in relation to each other during movements of the construction parts. These control devices are regularly mechanically constructed and are mostly kinematically designed with a so-called pivoting cross beam or elastically designed with spring elements as a so-called girder grid joint. In this design, also referred to as modular expansion joint, the total gap to be bridged between the construction parts is thus divided up into several individual gaps in a largely uniform manner.

A disadvantage of these mechanical solutions is that due to unavoidable flexibility, necessary play and wear, incorrect control occurs, with the variable gap widths being uneven. This, in turn, increases the wear of the control device, generates an increased noise level when vehicles pass over the construction joint and may even lead to dangerous situations due to an excessive gap width.

State-of-the-art solutions are known that use a hydraulic control device. Hydraulic control devices have the advantage that due to the approximate incompressibility of the hydraulic fluid, an even gap width can be set between the lamellae or between the lamellae and the edge girders.

For example, from DE 2 060 482 A a pneumatically or hydraulically operated control device with interconnected differential cylinders is known. In detail, the use of double-acting working cylinders is proposed, each with a movable piston and a piston rod arranged on the piston. Each piston rod is connected to a lamella or edge girder and the piston defines a first working volume and a second working volume of the corresponding working cylinder.

In order to bridge a construction joint with several lamellas, DE 2 060 482 A proposes to connect the working cylinders in pairs by connecting the first working volume of a first working cylinder with the second working volume of a second working cylinder and the first working volume of the second working cylinder with the second working volume of the first working cylinder. The piston rod of the first working cylinder is connected to the lamella on which also the second working cylinder is arranged. For particularly large construction joints, therefore, several such control devices with two working cylinders each are used. In addition, DE 2 060 482 A proposes the use of compressible pressure media in order to absorb potential shock loads.

This has the immediate disadvantage that several control devices must be used for large bridging devices, i.e. devices with more than one lamella, if all the lamellas are to be controlled. Consequently, the solution for the DE 2 060 482 A requires a large number of working cylinders, namely two working cylinders for each lamella from the second lamella onwards to be controlled. This increases the costs and also impairs the even gap width distribution, as the gap width is only indirectly transferred from one working cylinder to a second working cylinder. The disadvantages mentioned at the beginning are minimized due to the unavoidable play, but nevertheless errors of control can still occur to a lesser extent.

SUMMARY OF THE INVENTION

It is therefore the objective of the present invention to provide a bridging device with at least one hydraulic control device, which enables a particularly even control of the variable gap width between the lamellae or the edge beams and is at the same time more cost-effective to produce.

The solution of this problem is achieved with a bridging device according to claim 1. Advantageous further courses are described in the subsidiary claims.

The bridging device according to the invention is characterized with respect to the state of the art in particular by the fact that the hydraulic control device comprises at least three double-acting hydraulic cylinders which are connected to one another via a hydraulic connection, in that the first working volume of each hydraulic cylinder is hydraulically connected to the second working volume of another hydraulic cylinder, so that a hydraulic loop is formed between the at least three hydraulic cylinders. In particular, it is advantageous if the double-acting hydraulic cylinders are co-moving hydraulic cylinders in which the first working volume and the second working volume are of equal size. This ensures that the volume of the hydraulic fluid flowing in and out is the same.

According to the invention, with at least three double-acting hydraulic cylinders, with a relative movement of the building components, the variable gap width between at least four lamellas or edge beams can be evenly distributed. Due to the hydraulic loop all hydraulic cylinders are directly connected to each other, so that the movement of one single hydraulic cylinder is directly hydraulically transferred to all other hydraulic cylinders. In this way, the total volume of the first working volume of a hydraulic cylinder and the second working volume of a connected further hydraulic cylinder remains constant. Due to the largely backlash-free direct transmission of the movement between the hydraulic cylinders, a misguided control is theoretically impossible. Furthermore, with the hydraulic control device according to the invention, a bridging device can be realized in which fewer hydraulic cylinders are required, since due to the hydraulic loop there is no need to actuate a lamella via two hydraulic cylinders.

It is advantageous if the hydraulic control device is adapted to allow defined compensation movements. This allows the stiffness of the hydraulic control device to be reduced in a targeted manner, so that contamination-related blockages in the control device or temperature-related volume changes in the hydraulic fluid do not impair its function. In other words, the hydraulic control device has a kind of "internal flexibility" so that a purposeful play in the control of the gap widths can be realized.

It is particularly advantageous in this context if the hydraulic connection has at least one flow resistor. This can, for example, be designed as a throttle or orifice. Thus, the hydraulic control device can be designed to be sluggish or the gap widths can be controlled only when a limit pressure is exceeded. This avoids unnecessary small movements that occur, for example, during extremely short-term peak loads. This allows the maintenance intervals to be extended due to the reduced wear. Preferably the at least one flow resistor is arranged between the first working volume of a hydraulic cylinder and the second working volume of another hydraulic cylinder. It is also conceivable that a flow resistor is arranged between each first working volume of a hydraulic cylinder and the second working volume of another hydraulic cylinder.

Alternatively, it is advantageous if the hydraulic control device is hydraulically preloaded. This means that the operating pressure of the hydraulic control device is higher than the ambient pressure. In this way, particularly precise gap width control can be achieved, as the hydraulic control device is extremely stiff in this case. In this case, operating loads (e.g. due to acceleration or braking when driving over the bridging device) are channelled directly into the construction without displacement of the lamellas.

It is advantageous if the bridging device has at least one hydraulic accumulator. The hydraulic accumulator in particular enables maintaining the operating pressure when using a preloaded hydraulic control device. In this way, a for example temperature-related volume change of the hydraulic fluid can be compensated without the preloaded operating pressure rising or falling unacceptably.

The at least one hydraulic accumulator purposefully has a gas charging device and is in particular a bladder, piston or diaphragm accumulator. Bladder, piston or diaphragm accumulators have the advantage that they have a very high degree of efficiency and a very short reaction time to compensate for pressure fluctuations.

The at least one hydraulic accumulator is in further development connected to the hydraulic control device via a check valve. It is particularly useful here if an orifice plate check valve is used. In this way, the control device can be easily controlled by a short-term increase in pressure, whereas slow increases in pressure—for example due to temperature changes—are compensated by the hydraulic accumulator. Slow pressure increases are thus compensated by the hydraulic accumulator, and a pressure drop is immediately compensated. Therefore, it is largely impossible for the lines to run empty. It is therefore particularly useful if the inflow to the hydraulic accumulator is via the orifice, whereas the outflow is essentially via the check valve.

It is advantageous if the hydraulic control device has hoses to connect the working volumes of the hydraulic cylinders. Hoses have the advantage that they are flexible and can therefore follow the movements of the lamellae or hydraulic cylinders relative to each other without tension or wedging. It also facilitates the installation of the hydraulic control device, especially when the hydraulic control device is installed later on. It is also conceivable that at least partly pipes are used, for example with rotary connectors or a telescopic mechanism.

It is advisable to connect the hoses to the hydraulic cylinders via couplings, in particular plug-in couplings. This facilitates maintenance, replacement, installation and filling, emptying and venting of the hydraulic control device.

It is advantageous if at least one piston rod is hingingly connected to the lamella. It is conceivable that a pivot joint with one axis or a joint with several degrees of freedom, e.g. a ball joint or a socket joint, is used. Thereby also non-linear movements can be realized or compensated. In this context, it is also conceivable that the hydraulic cylinders are fixed to the lamellas or edge girders in a push-resistant but rotatable manner. It is also possible that the hydraulic cylinders are hingingly attached to the lamellas. This means that essentially all non-linear movements can be absorbed without damage.

The hydraulic control device usefully has at least one connection port for a pump. By connecting an external pump, lamellae can, for example, be specifically separated or retracted during maintenance. In addition, the hydraulic preload can also be adjusted or if necessary readjusted. Furthermore, the connection of the pump can also simplify the filling or emptying of the system. Here it is advantageous if the connection is located in the region of a coupling.

It is advantageous if the bridging device has a monitoring device for detecting pressure changes. It is particularly useful to monitor the pressure of the hydraulic control device via suitable sensors on the monitoring device so that a leakage or line breakage can be detected at an early stage.

It is conceivable that the bridging device has at least one mechanical and/or elastic control device, in particular a pivoting crossbeam. In this case, the hydraulic control device is advantageously intended as a support in order to achieve an even distribution of the gap widths. In particular, in this case it is not necessary to control each lamella via the hydraulic control device. Rather, for example, only every n-th lamella (e.g. every second or third lamella) can be additionally controlled via the hydraulic control device.

In conventional bridging devices with mechanical or elastic control devices, one end of the bridging device is usually more prone to malcontrol than the other. On the one hand, this can be due to a stronger movement of the lamellae towards one end. On the other hand, this is also due to the regularly one-sided control action. Such a malcontrol occurs particularly strongly with a longitudinal gradient, since larger loads occur on the valley side.

It is therefore advantageous if at least one hydraulic cylinder is a first hydraulic cylinder with a first cross-section and if another hydraulic cylinder is a second hydraulic cylinder with a second cross-section, wherein the first cross-section is different from the second cross-section. In particular, the sum of the first working volume and the second working volume of the first hydraulic cylinder is equal to the sum of the first working volume and the second working volume of the second hydraulic cylinder. In other words, the cross-section of the first hydraulic cylinder is larger or smaller than the cross-section of the second hydraulic cylinder. This results in a smaller piston stroke for the hydraulic cylinder with the larger cross-section than for the hydraulic cylinder with the smaller cross-section. Due to a constant product of cross-sectional area and piston stroke, a hydraulic loop can still be realized.

This has the advantage that the hydraulic cylinder with a smaller cross-section has a larger control stroke than the hydraulic cylinder with the larger cross-section. Due to the larger control stroke, a larger number of lamellae can therefore be skipped with the hydraulic cylinder with a smaller cross-section. The hydraulic cylinder with a smaller cross-section and thus with a shorter control stroke is used to provide support in the area of the bridging device, where the miscontrols are usually relatively large.

BRIEF DESCRIPTION OF THE DRAWINGS

In the following, the invention is explained in more detail using the embodiments shown in the figures. Here.

In the figures the same parts are provided with the same reference signs. Furthermore, in the case of redundant parts, some reference signs are not displayed due to an improved overview.

DETAILED DESCRIPTION

Figure 1:
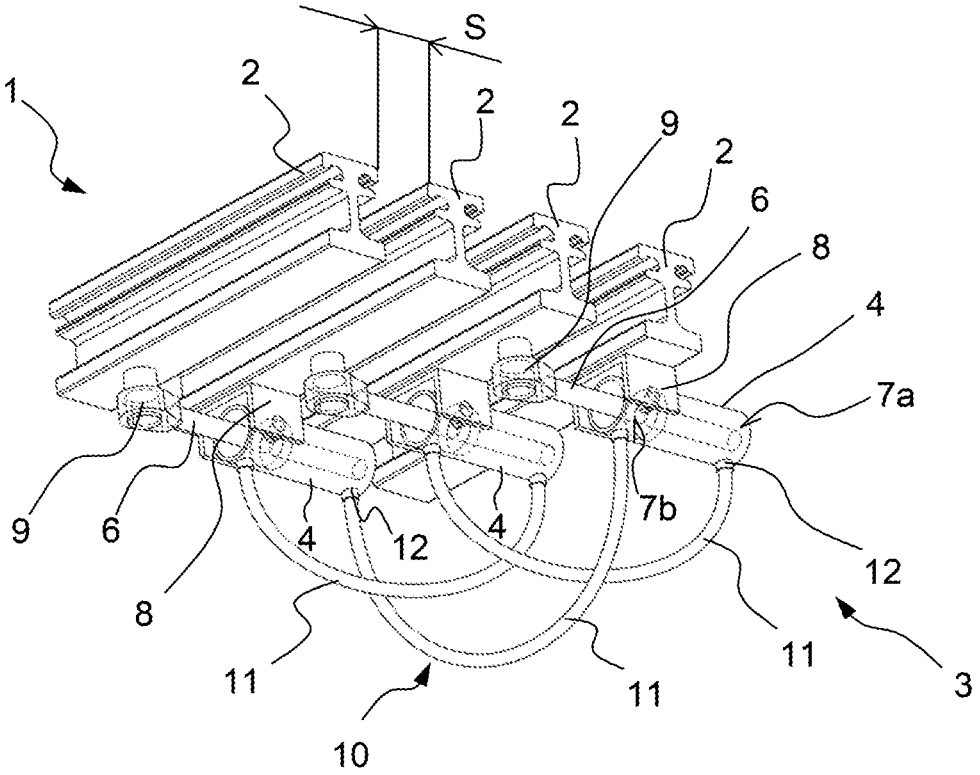
FIG. 1 shows schematically a perspective view of a part of an inventive bridging device according to a first embodiment.

FIG. 1 shows a section of a bridging device 1 of lamellar construction. The bridging device 1 bridges a construction joint between two (not shown) construction parts. For this purpose the bridging device 1 has several lamellae 2 which are movable relative to each other. In addition, the bridging device 1 has a hydraulic control device 3. The hydraulic control device 3 is intended for controlling the gap widths S between the lamellae 2. In this embodiment shown in FIG. 1 and FIG. 2, the hydraulic control device 3 consists of three double-acting hydraulic cylinders 4. The hydraulic cylinders 4 are all of the same design so that the design of one hydraulic cylinder 4 is described hereafter.

The hydraulic cylinder 4 has a piston 5 and a piston rod 6, which is connected to the piston 5 in a push-proof way. The piston 5 defines a first (changing) working volume 7*a* and a second (changing) working volume 7*b* in the hydraulic cylinder 4. Each hydraulic cylinder 4 is connected to a lamella 2 (or a not shown edge girder on the construction part). In this embodiment, the hydraulic cylinder 4 is fixed to the lamella 2 via a clamp 8. The clamp 8 is designed so that the hydraulic cylinder 4 is beared rotatable about its vertical axis and its cross axis. As shown, the hydraulic cylinder 4 is a co-moving cylinder in which the piston rod 6 extends on both sides of the piston 5.

The piston rod 6 is hinged at one end 9 to a second lamella 2. In this embodiment, the end 9 of the piston rod 6 is hinged to the lamella 2, which is directly adjacent to the lamella 2, on which the hydraulic cylinder 4 with the piston rod 6 is arranged.

The hydraulic cylinders 4 are connected to each other via a hydraulic connection 10. The hydraulic connection 10 consists of three hoses 11, the ends of which are each hydraulically connected via a coupling 12 to a working volume 7*a*, 7*b* of a hydraulic cylinder 4. In particular, a first working volume 7*a* of a hydraulic cylinder 4 is always hydraulically connected to the second working volume 7*b* of another hydraulic cylinder 4 via a hose 11. This creates a hydraulic loop between the hydraulic cylinders 4.

The hydraulic loop of the hydraulic cylinders 4 requires an even gap width S between adjacent lamellae 2 or between a lamella 2 and the edge girder (not shown) of a construction or bridge part. Since the total volume of a hydraulic cylinder 4 always consists of the first working volume 7*a* and the second working volume 7*b*, the total volume remains constant when the piston 5—and therefore also the piston rod 6—moves. Furthermore, the total volume also corresponds to the sum of the volume of the first working volume 7*a* of a hydraulic cylinder 4 and the volume of the second working volume 7*b* of the other hydraulic cylinder 4 connected to it via the hose 11.

When the construction parts move, the movement is transferred to the lamellae 2. The lamellae 2 move the respective pistons 4 in the hydraulic cylinders 4 via the hinged piston rods 6. This changes the ratio of the first working volume 7*a* to the second working volume 7*b* in each hydraulic cylinder 4. Due to the hydraulic connection 10 between the working volumes 7*a*, 7*b* of the three hydraulic cylinders 4, a change in the first working volume 7*a* of a hydraulic cylinder 4 is transferred directly and loss-free to the second working volume 7*b* of the hydraulic cylinder 4 hydraulically connected to it. As a result, the gap widths S between the lamellae 2 or between a lamella 2 and an edge girder are evenly distributed. In other words, all gap widths S are practically identical, so that there are no miscontrols.

Figure 2:
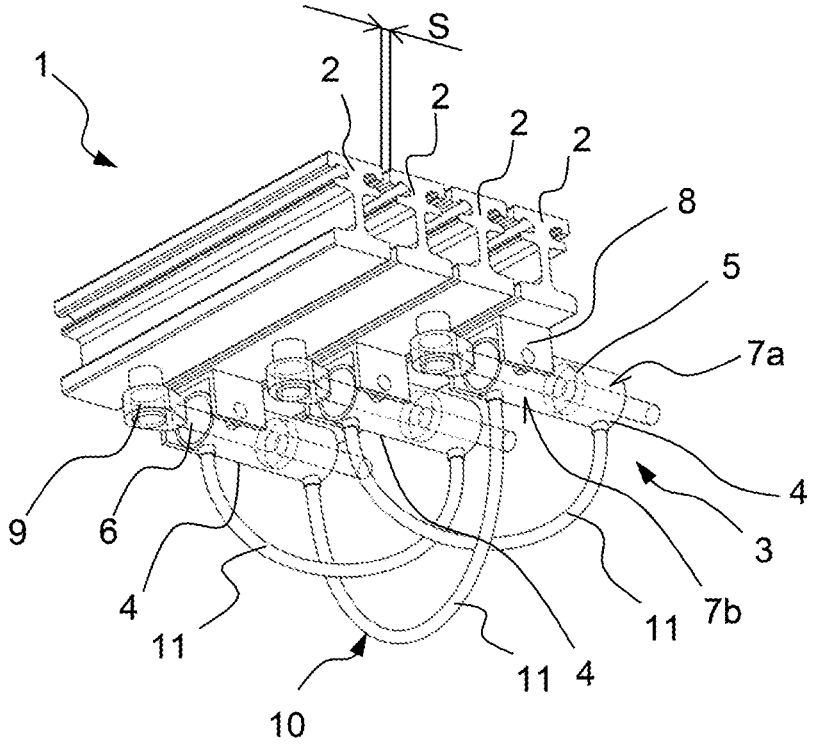
FIG. 2 shows schematically the partial area shown in FIG. 1 in the retracted state.

In practice, this means that when the construction parts move towards each other and the lamellae 2 are thereby pushed together, the piston rods 6 increase the second working volume 7*b* and reduce the first working volume 7*a* via the piston 5. The piston 5 moves to the right as shown in FIG. 2. This change in volume of the working volumes 7*a*, 7*b* is transferred evenly to all three hydraulic cylinders 4 due to the hydraulic connection 10 designed as a loop connection. This can also be seen clearly from a combined view of FIG. 1 (extended state) and FIG. 2 (retracted state). The gap widths S are identical and the pistons 5 are at identical positions within the hydraulic cylinders 4.

Figure 3:
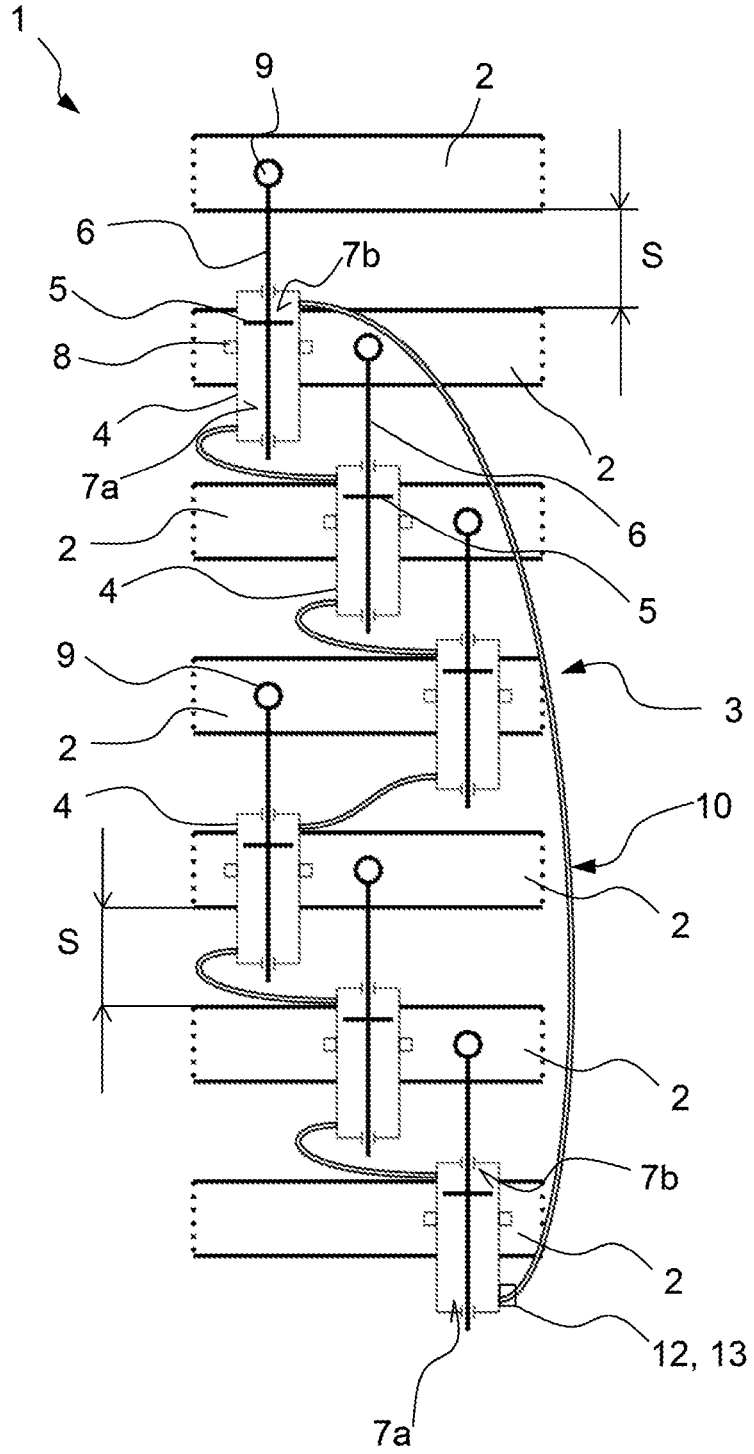
FIG. 3 shows schematically a bottom view of an inventive bridging device according to a second embodiment.
Figure 4:
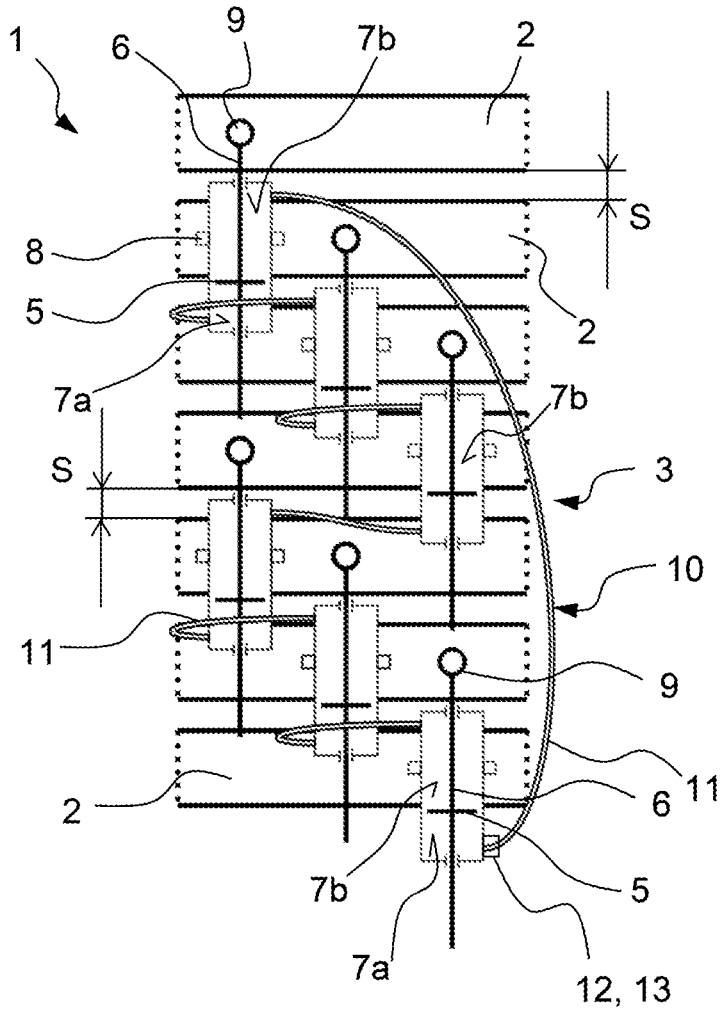
FIG. 4 shows schematically the bridging device shown in FIG. 3 in the retracted state.

In FIGS. 3 and 4 a second embodiment is shown as a plan view. This embodiment essentially corresponds to the embodiment shown in FIG. 1 and FIG. 2, whereby the hydraulic control device 3 has six hydraulic cylinders 4 in total. A total of seven lamellae 2 or five lamellae 2 and two edge girders are controlled via these six hydraulic cylinders 4. Even if it is basically irrelevant whether or not the first working volume 7*a* of a hydraulic cylinder 4 (e.g. the hydraulic cylinder 4 shown as the lowest in FIG. 3 and FIG. 4) is hydraulically connected to the second working volume 7*b* of the directly adjacent hydraulic cylinder 4 via the hose 11, this is recommended for practical reasons. On the one hand, this improves visibility and allows an improved response, as the volumes in the hoses can be kept low.

From a combined view of FIG. 3 and FIG. 4 it is also easy to recognize that the gap width S is identical both in the extended state of the bridging device 1 (see FIG. 3) and in the retracted state of the bridging device 1 (see FIG. 4) between the lamellae 2 or between a lamella 2 and an edge girder.

The second embodiment of the bridging device 1 according to the invention differs from the embodiment shown in FIG. 1 and FIG. 2 in that the hydraulic cylinder 4 shown as the lowest has a further connection 13 for an external pump (not shown) in the area of the coupling 12 of the first working volume 7*a*. Via this connection 13, adjacent lamellae 2 of the bridging device 1 can be selectively moved apart or together by changing the operating pressure of the hydraulic control device 3 at the corresponding point via the pump. This may be necessary, for example, for functional tests or maintenance work.

Figure 5:
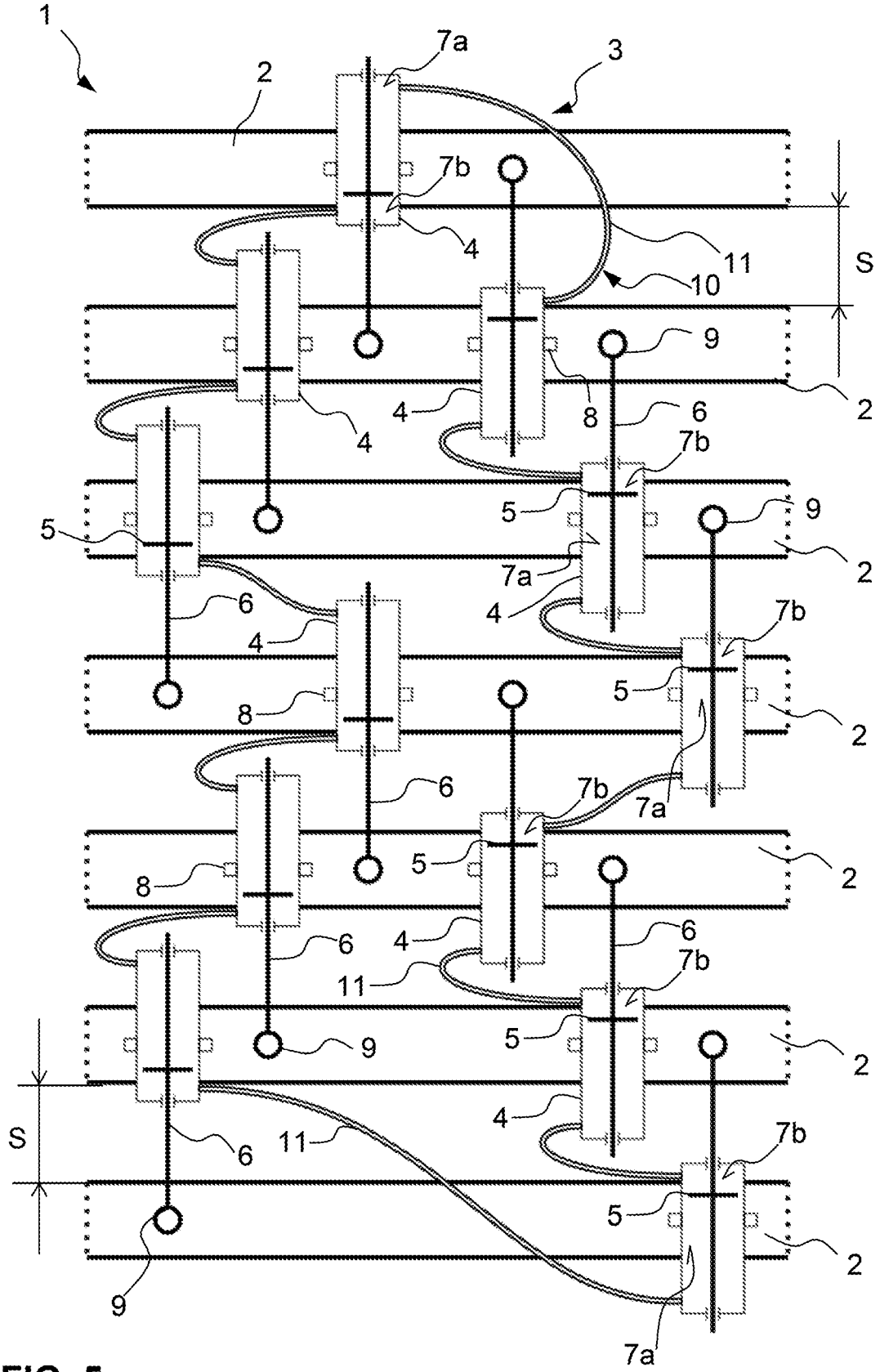
FIG. 5 shows schematically a bottom view of an inventive bridging device according to a third embodiment.

A third embodiment of a bridging device 1 according to the invention in plan view is shown in FIG. 5. The bridging device 1 largely corresponds to the bridging device 1 shown in FIG. 3, whereby the hydraulic control device 3 has a total of twelve hydraulic cylinders 4. As in the embodiment shown in FIG. 3, seven lamellae 2 or five lamellae 2 and two edge girders are controlled via the hydraulic control device 3. The twelve hydraulic cylinders 4 are also connected via a hydraulic connection 10 by means of hoses 11 to form a hydraulic loop. The first working volume 7*a* of a hydraulic cylinder 4 is connected to the second working volume 7*b* of another hydraulic cylinder 4.

In contrast to the embodiment shown in FIG. 3, here a lamella 2 is controlled by two hydraulic cylinders 4. In other words, two piston rods 6 are hinged to each of the five middle lamellae 2 (i.e. not to the edge girders, which in this embodiment are formed by the two outer lamellae 2) with their ends 9. Such a double control of the lamellae 2 by the hydraulic control device 3 is advantageous for relatively large bridging devices 1, for example to prevent the lamellae 2 from tilting in wide construction joints to be bridged.

Figure 6:
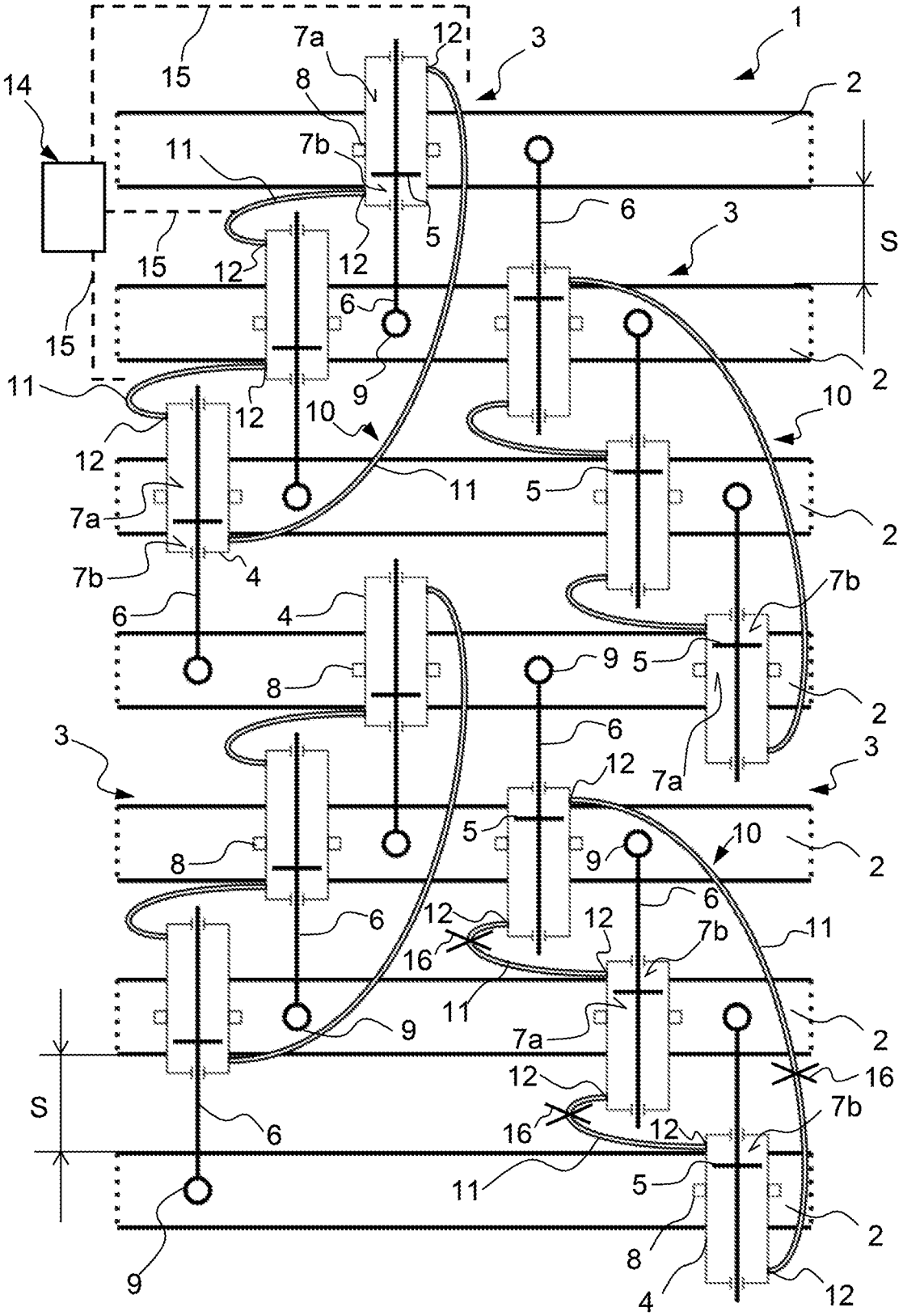
FIG. 6 shows schematically a bottom view of an inventive bridging device according to a fourth embodiment.

FIG. 6 shows a fourth embodiment of a bridging device 1 according to the invention. In this embodiment, the bridging device 1 has a total of four separate hydraulic control devices 3, each of which has three double-acting hydraulic cylinders 4. The three hydraulic cylinders 4 of each hydraulic control device 3 are connected via a hydraulic connection 10 by means of hoses 11 to form a hydraulic loop. In this respect, several hydraulic control devices 3 with hydraulic loop closure are provided in this embodiment.

This sixth embodiment also includes a monitoring device 14. This monitoring device 14 monitors the operating pressure of the hydraulic control devices 3. The hydraulic connection 10 is monitored via corresponding sensors 15. If a drop in pressure within the hydraulic connection 10 is detected, the monitoring device 14 indicates this. As an example, this is indicated by dotted lines for the uppermost shown hydraulic control device 3. Of course the monitoring device 14 monitors all hydraulic control devices 3 of the bridging device 1.

Furthermore, the monitoring device 14 is configured to detect short-term pressure fluctuations due to the movement of the construction parts as such. The monitoring device 14 indicates no leakage at these short-term pressure changes. For example, the monitoring device 14 can indicate a leakage once the operating pressure does not correspond to the target pressure for a certain period of time. In this way, even a creeping drop in operating pressure can be detected at an early stage.

In this embodiment, the lowest hydraulic control device 3 is provided with flow resistors 16 in the hydraulic connection 10. In particular, the flow resistors 16 are arranged as orifices in the hoses 11. The flow resistors can make the hydraulic control device 3 specifically sluggish so that short-term loads do not lead to any movement in the bridging device 1. This is relevant if the hydraulic control device 3 does not require hydraulic preload as shown (cf. also FIG. 9). Of course, several flow resistors 16 can be provided as shown. It is also conceivable that only one flow resistor 16 is provided. It is also conceivable that the flow resistor 16 is designed as a valve unit on the coupling 12.

Figure 7:
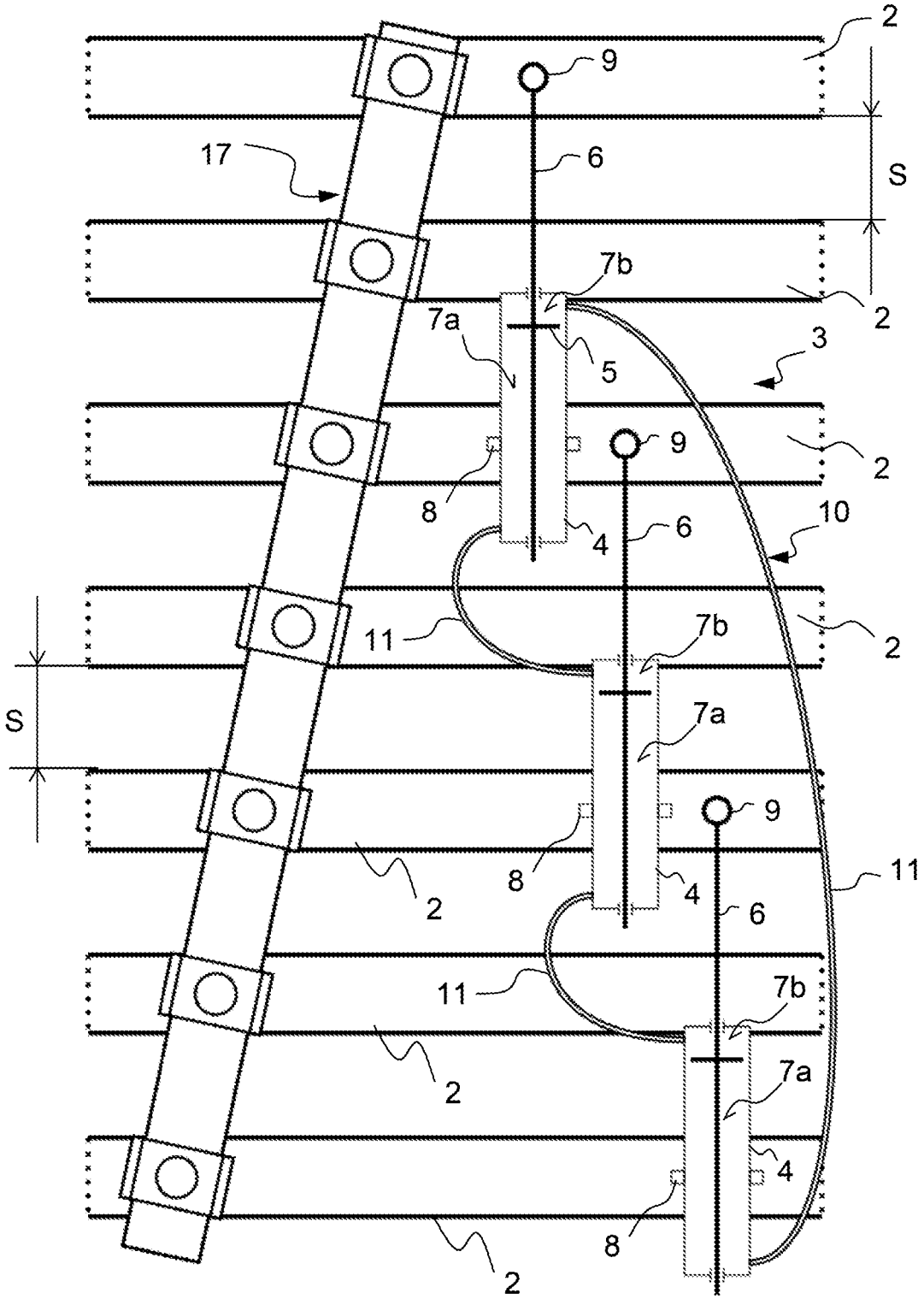
FIG. 7 shows schematically a bottom view of an inventive bridging device according to a fifth embodiment.

A fifth embodiment of a bridging device 1 according to the invention is shown in FIG. 7. In this embodiment, the hydraulic control device 3 is used in support for a mechanical control device 17 in the form of a pivoting cross beam. The pivoting cross beam 17 primarily controls the gap widths S between the lamellae 2 in a conventional and familiar way. In this embodiment, the hydraulic control device 3 consists of three hydraulic cylinders 4 and is essentially constructed analogously to the hydraulic control device 3 shown in the first embodiment according to FIG. 1. The difference can be seen in the fact that, according to the fifth embodiment, the hydraulic control device 3 only controls every second lamella 2. Therefore, the hydraulic control device 3 is designed to support the pivoting cross beam 17 and minimizes the possibility of miscontrolling. This fifth embodiment is particularly suitable as a retrofit solution for existing bridging devices 1, as the actual control of the gap widths S is carried out mechanically via the pivoting cross beam 17. Nevertheless, miscontrols can be largely avoided in this way.

Figure 8:
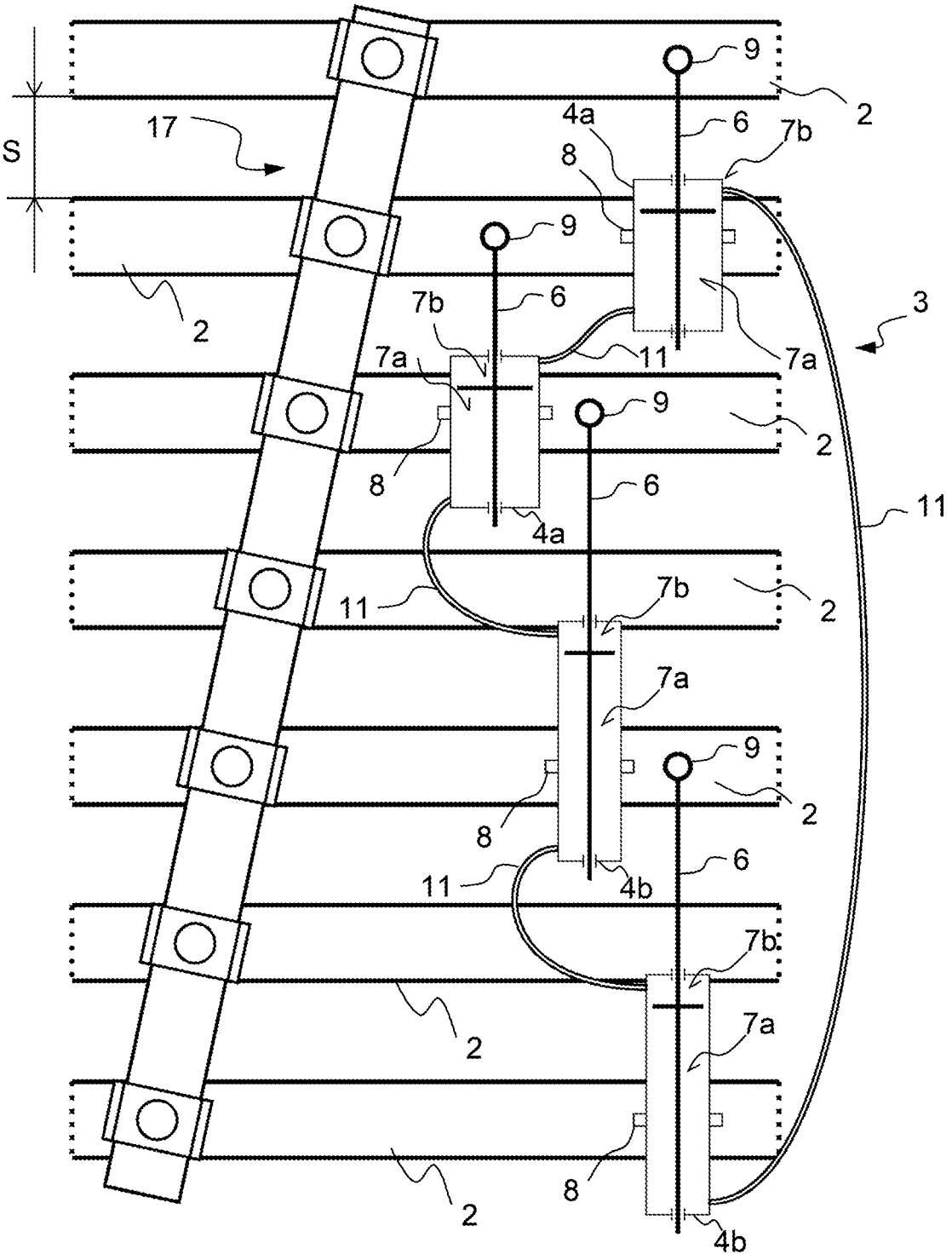
FIG. 8 shows schematically a bottom view on a hydraulic control device according to a sixth embodiment with different cross-sections of the hydraulic cylinders.

FIG. 8 shows a sixth embodiment of a bridging device 1 according to the invention. In this desi embodiment, the bridging device 1 has a mechanical control device 17 in the form of a pivoting cross beam, analogous to the embodiment shown in FIG. 7. The hydraulic control device 3 is employed as a support. The difference to the bridging device 1 shown in FIG. 7 is that the hydraulic control device has two first hydraulic cylinders 4*a* with a first cross-section and two second hydraulic cylinders 4*b* with a second cross-section. As illustrated, the first hydraulic cylinders 4*a* control the directly adjacent lamella 2, whereas the second hydraulic cylinders 4*b* control the second lamella 2. The shorter control stroke required for this with a correspondingly shorter piston rod 6 of the first hydraulic cylinder 4*a* is achieved by a larger cross-section compared to the second hydraulic cylinder 4*b*. The hydraulic loop of hydraulic cylinders 4*a*, 4*b* results from the constant product of cross-sectional area and piston stroke, which is identical for the first hydraulic cylinders 4*a* and for the second hydraulic cylinders 4*b*. This largely prevents miscontrols, especially in the region of the first hydraulic cylinder 4*a*. Such a hydraulic control device 3 designed to support a mechanical control device 17 or elastic control device is particularly suitable for bridging devices 1 with longitudinal gradient.

Figure 9:
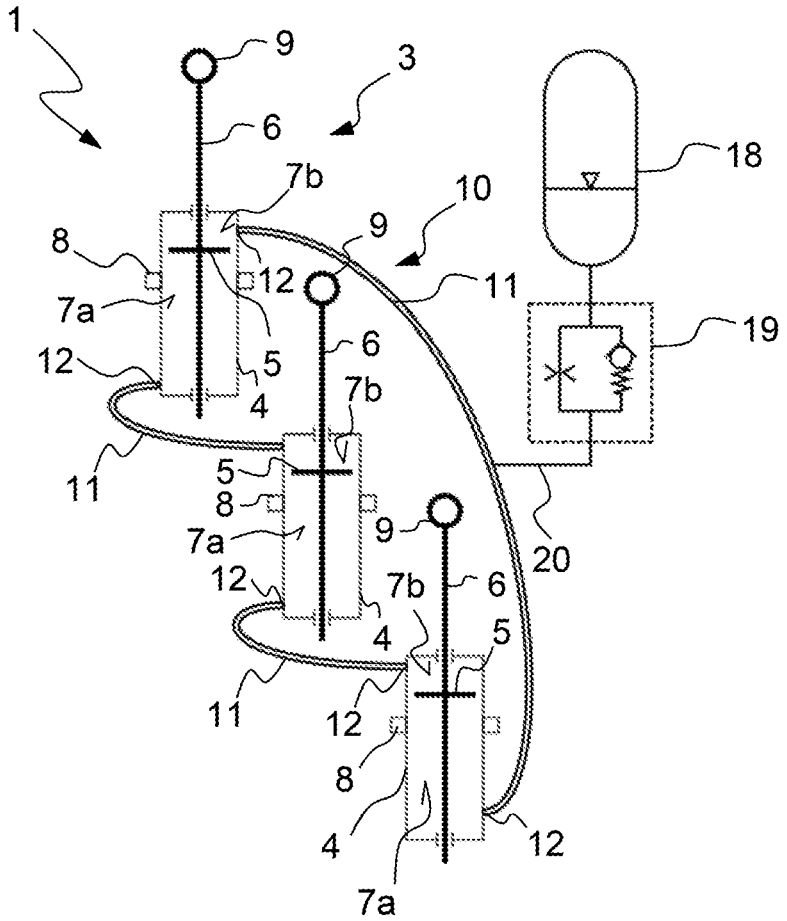
FIG. 9 shows schematically a bottom view of a hydraulic control device with hydraulic accumulator.

The first to sixth embodiment according to FIGS. 1 to 8 has in common that they work without hydraulic preload. Alternatively, FIG. 9 shows a seventh embodiment of a bridging device 1 according to the invention, in which the hydraulic control device 3 is hydraulically preloaded, i.e. has an increased operating pressure. Due to the hydraulic preload, the hydraulic control device 3 responds particularly quickly and precisely. The hydraulic control device 3 essentially corresponds to the hydraulic control device 3 shown in FIG. 1, whereby the hydraulic control device 3 has a hydraulic accumulator 18 with a gas charging device. The hydraulic accumulator 18 can, for example, be a diaphragm, bladder or piston accumulator. The hydraulic accumulator 18 is connected via a spring-loaded orifice plate check valve 19 to the hydraulic control device 3 via corresponding connecting lines 20, which can be connected to a hose 11 as shown. This creates a compensating volume, which can be used, for example, to compensate for a temperature-induced change in the volume of the hydraulic fluid. An unacceptable increase or decrease in operating pressure is therefore prevented.

LIST OF REFERENCE SIGNS

1 Bridging device
2 Lamella
3 Hydraulic control device
4 Hydraulic cylinder
4*a* First hydraulic cylinder
4*b* Second hydraulic cylinder
5 Piston
6 Piston rod
7*a* First working volume
7*b* Second working volume
8 Clamp
9 End of piston rod
10 Hydraulic connection
11 Hose
12 Coupling
13 Connection
14 Monitoring device
15 Sensor
16 Flow resistor
17 Mechanical control device
18 Hydraulic accumulators
19 Orifice plate check valve
20 Connection line
S Gap width

The invention claimed is:

1. A bridging device of lamellar construction for a construction joint between a first construction part and a second construction part, having a plurality of lamellae and at least one hydraulic control device for controlling the gap width between the lamellae, the hydraulic control device having double-acting hydraulic cylinders each having one movable piston and one piston rod arranged on the piston, wherein each hydraulic cylinder is arranged on one lamella, and each piston rod is connected to another lamella, and wherein the piston defines a first working volume and a second working volume of the corresponding hydraulic cylinder, wherein the hydraulic control device has at least three double-acting hydraulic cylinders which are connected to one another via a hydraulic connection, in that the first working volume of each hydraulic cylinder is hydraulically connected to the second working volume of another hydraulic cylinder, so that a hydraulic loop is formed between the at least three hydraulic cylinders.

2. The bridging device according to claim 1, wherein the hydraulic control device is adapted to allow defined compensating movements.

3. The bridging device according to claim 1, wherein the hydraulic control device is hydraulically preloaded.

4. The bridging device according to claim 1, wherein at least one piston rod is hingingly connected to the lamella.

5. The bridging device according to claim 1, wherein the hydraulic control device has at least one connection port for a pump.

6. The bridging device according to claim 1, wherein the bridging device has a monitoring device for detecting pressure changes.

7. The bridging device according to claim 1, wherein the hydraulic connection has at least one flow resistor.

8. The bridging device according to claim 7, wherein the at least one flow resistor is arranged between the first working volume of a hydraulic cylinder and the second working volume of another hydraulic cylinder.

9. The bridging device according to claim 1, wherein the bridging device has at least one hydraulic accumulator.

10. The bridging device according to claim 9, wherein the at least one hydraulic accumulator has a gas charging device and comprises a bladder, piston or diaphragm accumulator.

11. The bridging device according to claim 9, wherein the at least one hydraulic accumulator is connected to the hydraulic control device.

12. The bridging device according to claim 11, wherein the check valve is a orifice plate check valve.

13. The bridging device according to claim 1, wherein the hydraulic control device comprises hoses for connecting the working volumes of the hydraulic cylinders.

14. The bridging device according to claim 13, wherein the hoses are connected to the hydraulic cylinders via plug-in couplings.

15. The bridging device according to claim 1, wherein the bridging device has at least one mechanical or elastic steering device, comprises a pivoting crossbeam.

16. The bridging device according to claim 15, wherein at least one hydraulic cylinder is a first hydraulic cylinder having a first cross-section and another hydraulic cylinder is a second hydraulic cylinder having a second cross-section, wherein the first cross-section is different from the second cross-section.

17. The bridging device according to claim 16, wherein the sum of the first working volume and the second working volume of the first hydraulic cylinder is equal to the sum of the first working volume and the second working volume of the second hydraulic cylinder.

* * * * *